US005544001A

United States Patent [19]

Ichiya et al.

[11] Patent Number: 5,544,001

[45] Date of Patent: Aug. 6, 1996

[54] ELECTROSTATIC RELAY

[75] Inventors: Mitsuo Ichiya, Hirakata; Fumihiro Kasano, Sakai; Hiromi Nishimura, Takatsuki, all of Japan; Jacques Lewiner, Saint-Cloud; Dider Perino, Rueil Malmaison, both of France

[73] Assignees: Matsushita Electric Works, Ltd., Osaka, Japan; Jacques Lewiner, Saint-Cloud; Dider Perino, Rueil Malmaison, both of France

[21] Appl. No.: 188,414

[22] Filed: Jan. 24, 1994

[30] Foreign Application Priority Data

Jan. 26, 1993 [JP] Japan ..... 5-010607

[51] Int. Cl.[6] ..... H01H 57/00

[52] U.S. Cl. ..... 361/233; 361/207; 200/181; 307/400

[58] Field of Search ..... 200/181; 361/207, 361/233, 211; 307/400

[56] References Cited

U.S. PATENT DOCUMENTS 4,078,183 3/1978 Lewiner et al. .
5,278,368 1/1994 Kasano et al. ..... 361/207 X

FOREIGN PATENT DOCUMENTS 0520407 12/1992 European Pat. Off. .
4392204 9/1993 Germany .
2-100224 4/1990 Japan .

*Primary Examiner*—Fritz M. Fleming
*Attorney, Agent, or Firm*—Armstrong, Westerman, Hattori, McLeland & Naughton

[57] ABSTRACT

An electrostatic relay comprises at least one fixed base having a fixed electrode and an actuator frame having a movable electrode. The fixed base carries a pair of fixed contacts insulated from the fixed electrode. The movable electrode carries a movable contact insulated from the movable electrode. The movable electrode extends along the fixed electrode and is pivotally supported at its one longitudinal end relative to the fixed base so as to pivot between two contacting positions of closing and opening the movable contact to and from the fixed contacts. The movable contact is formed at the other longitudinal end of the movable electrode. A control voltage source is connected across the fixed electrode and the movable electrode to generate a potential difference therebetween for developing an electrostatic force by which the movable electrode is attracted toward said fixed electrode to move into one of the two contacting positions. The electrostatic relay is characterized in that the movable electrode is cooperative with the fixed electrode to define therebetween an elongate gap which is narrower toward the one longitudinal end about which the movable electrode pivot than at the other longitudinal end of the movable electrode at which the movable contact is carried.

7 Claims, 13 Drawing Sheets

ELECTROSTATIC RELAY

BACKGROUND OF THE INVENTION

1. Field of the Invention

The present invention is directed to an electrostatic relay driven by an electrostatic force to open and close a contact.

2. Description of the Related Art

Electrostatic relays are known in the art, for example, as disclosed in U.S. Pat. No. 4,078,183 and Japanese Patent Early Publication (KOKAI) No. 2-100224. The electrostatic relay of U.S. Pat. No. 4,078,183 comprises a pair of parallel fixed electrodes and a movable electret which is disposed between the fixed electrodes and is supported at one end to a common base to the fixed electrodes. The movable electret carries a movable contact at the other end which is made movable toward and against the adjacent portions of the fixed electrodes for closing and opening the movable contacts to and from associated fixed contacts on the fixed electrodes. The movable electret is charged to have different electric charges from one side to the other side of the electret so that, when no control voltage is applied across the fixed electrodes, the movable electret is kept attracted to one of the fixed electrodes to close the movable contact to the associated fixed contact on the fixed electrode. When a control voltage of a given polarity is applied across the fixed electrodes, the electret is attracted toward the other fixed electrode to open the contacts. In the relay of this patent, the movable electret extends generally in parallel with the fixed electrodes, particularly at one end portion at which the electret is supported to the common base such that a gap of substantially constant width remains between the supporting end of the movable electret and the adjacent fixed electrodes. With this gap of substantially constant width, a relatively large electric potential is required to move the contact end of the electret between the fixed electrodes by electrostatic force for closing and opening the contacts. Therefore, there remains a certain limitation in obtaining a large electrostatic force enough to move the movable electret between the fixed electrodes for closing and opening the contacts with a less electric potential applied across the fixed electrodes. With this result, it is also difficult to obtain a sufficient contacting pressure with a small electric potential applied across the fixed electrodes.

The electrostatic relay of Japanese patent No. 2-100224 comprises a base mounting thereon a pair of fixed electrodes and an actuator frame superimposed on the base. The actuator frame defines therein a pair of movable electrodes each in the form of a flap supporting at its one end to the frame and extending along the adjacent fixed electrode. The movable electrode is allowed to pivot about the supporting end for closing and opening a movable contact on the free end of the movable electrode to and from associated fixed contacts on the base. An external control voltage source is connected to apply a potential difference across the fixed electrode and the movable electrode to generate an electrostatic force between the movable electrode and the associated fixed electrode, whereby attracting the movable electrode toward the base for closing the contacts. Upon no electric potential being applied between the movable electrode and the fixed electrodes, the movable electrode returns to a neutral position of opening the contacts by inherent resiliency given to the movable electrode. Also in this relay, the movable electrode extends generally in parallel with the adjacent fixed electrode to leave a gap of constant width along the movable electrode when no electric potential is applied across the movable electrode and the fixed electrode. Therefore, this relay suffers also from the limitation in that a electrostatic force large enough to attract the movable electrode towards the fixed electrode for closing the contacts is difficult to obtain with a small applied electric potential. Therefore, it is likewise difficult to obtain a sufficient contacting pressure with a small applied electric potential.

SUMMARY OF THE INVENTION

The above problem and insufficiency has been eliminated in the present invention which provides an improved electrostatic relay. The electrostatic relay of the present invention comprises a fixed base having a fixed electrode and an actuator frame superimposed on the fixed base. The fixed base carries a pair of fixed contacts insulated from the fixed electrode. The actuator frame includes an elongated movable electrode which extends along the fixed electrode and is supported at its one longitudinal end with a movable contact formed on the other longitudinal end as being insulated from the movable electrode. Thus, the movable electrode is pivotally movable about the supporting end between two contacting positions of closing and opening the movable contact to and from the fixed contacts. A control voltage source is connected across the fixed electrode and the movable electrode to generate a potential difference therebetween for developing a resulting electrostatic force by which the movable electrode is attracted toward the fixed electrode to move into one of the two contacting positions. The characterizing feature of the electrostatic relay resides in that the movable electrode is cooperative with the fixed electrode to define therebetween an elongate gap which is narrower toward the one longitudinal end about which the movable electrode is allowed to pivot than at the other longitudinal end of the movable electrode at which the movable contact is carried. With the provision of the narrowing gap towards the supporting end of the movable electrode, it is readily possible to develop a large electrostatic force for attracting the movable electrode with a less electric potential applied across the fixed and movable electrodes, while leaving a sufficient insulation spacing between the fixed contact and movable contact in an open contact condition. Consequently, a large contacting pressure can be obtained with improved contacting reliability free from external shocks or vibrations experienced during use.

Accordingly, it is a primary object of the present invention to provide an improved electrostatic relay which is capable of obtaining a large electrostatic force to reliably attract the movable electrode to the fixed electrode and assuring a large contacting pressure with a minimum electric potential applied across the movable electrode and the fixed electrode.

The narrowing gap between the movable electrode and the fixed electrode can be made by forming at least one steps on the confronting surface of either or both of movable electrode and the fixed electrode. Alternately, the gap may be made by shaping the confronting surface of either or both of the movable electrode and the fixed electrode into a tapered or inclined surface.

Preferably, an electret is disposed on the fixed electrode in an adjacent relation to the movable electrode so as to give an additional electrostatic force of attracting the movable electrode towards the fixed electrode. With the addition of the electret, it is possible to assure a further improved contacting operation with increased and reliable contacting pressure with a minimum applied electric potential across the movable and fixed electrodes, which is therefore another object of the present invention.

In preferred embodiments, a secondary fixed base is added on an opposite side of the primary fixed base from the actuator frame. The secondary base has a secondary fixed electrode confronting the movable electrode for applying a potential difference therebetween and is formed with a pair of secondary fixed contacts which come into contact with an additional contact formed on the movable electrode. The primary fixed base and the secondary fixed base are stacked on the actuator frame and integrally bonded thereto. With the addition of the secondary fixed base, it is readily possible to make a transfer switching operation of closing the movable contact on one side of the movable electrode while at the same time opening the movable contact on the other side of the movable electrode by suitably controlling to apply the electric potential across the movable electrode and the primary and secondary fixed electrodes.

It is therefore a further object of the present invention of providing an improved electrostatic relay which is capable of effecting the transfer switching operation with a simple configuration.

In this instance, a secondary electret is disposed on the secondary fixed electrode in an adjacent relation to the movable electrode to give an additional electrostatic force of attracting the movable electrode towards the secondary fixed base for enhanced and reliable contacting operation with a minimum applied electric potential, which is therefore a still further object of the present invention.

The fixed base and the actuator frame are each formed of a silicon wafer and integrally bonded together into one unitary structure in which the fixed base and the actuator frame can be free from different thermal expansion as opposed to a case in which they are formed from different material. Therefore, the relay can be made thermally stable and reliable in its contacting operation over a wide temperature range of use. Further, due to the use of the silicon wafer as the fixed base, it is readily possible to integrate a necessary electric circuit in the fixed base by an integration technique. The electric circuit may be a voltage step-up circuit for generating a step-up voltage across the movable and fixed electrodes for driving the relay, a control circuit for applying the control voltage of a suitable polarity across the movable electrode and the fixed electrode, and/or a discharge circuit for discharging unnecessary charges accumulated in the fixed electrodes and the movable electrode. Therefore, it is possible that the relay can be dispensed with an external driving circuit, which is therefore a still further object of the present invention.

These and still other objects and advantageous features will become more apparent from the following detailed description of the embodiments of the present invention when taken in conjunction with the attached drawings.

DETAILED DESCRIPTION OF THE EMBODIMENTS

Figure 1:
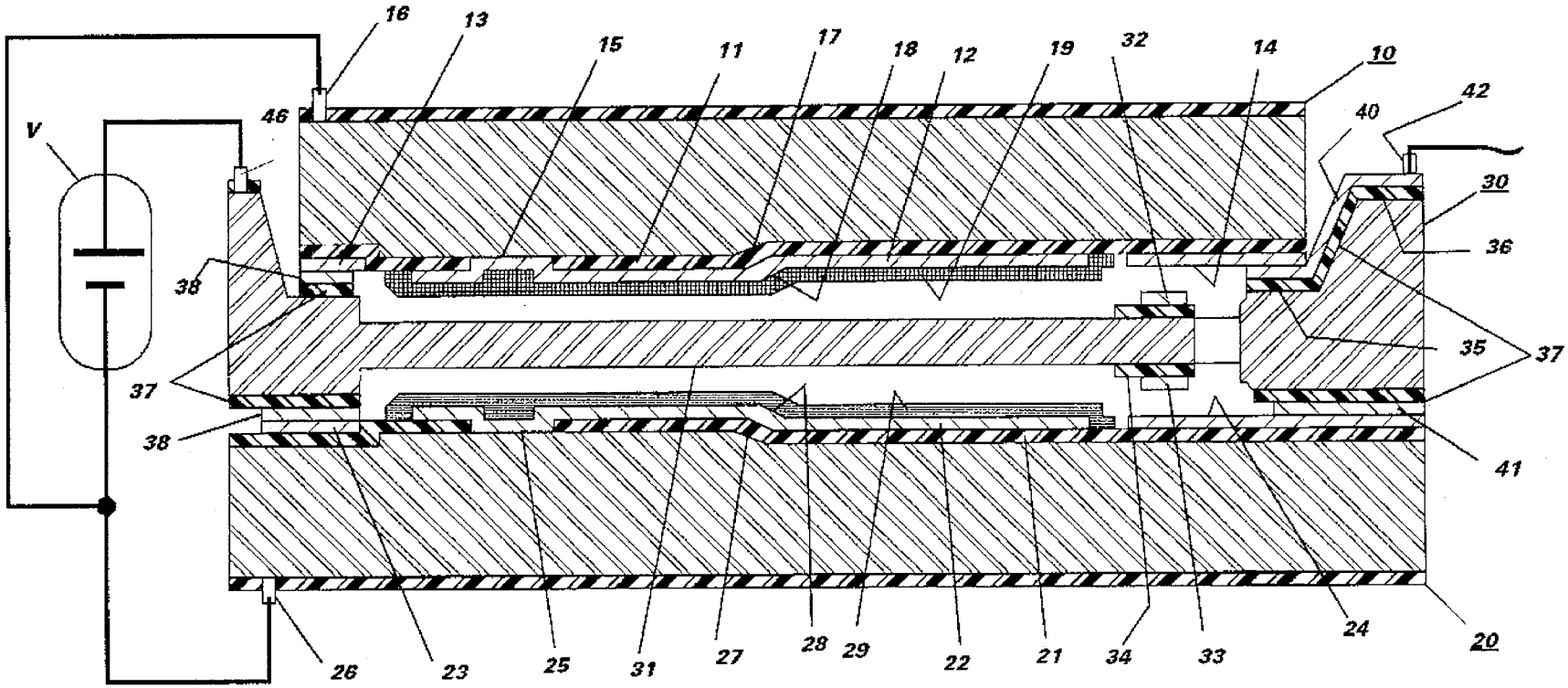
FIG. 1 is a front sectional view of an electrostatic relay in accordance with a first embodiment of the present invention.
Figure 2:
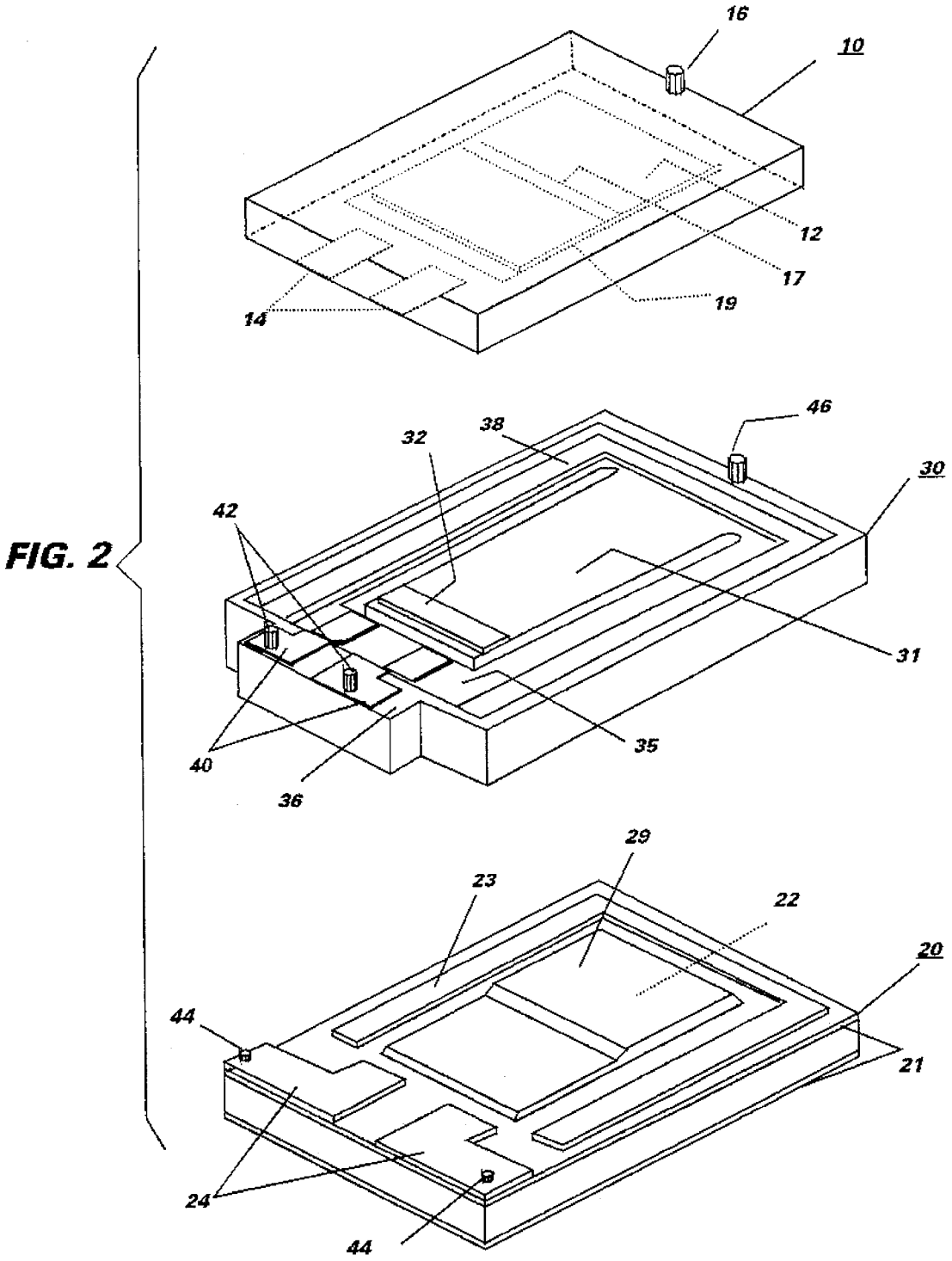
FIG. 2 is an exploded perspective view of the relay of FIG. 1.
Figure 3:
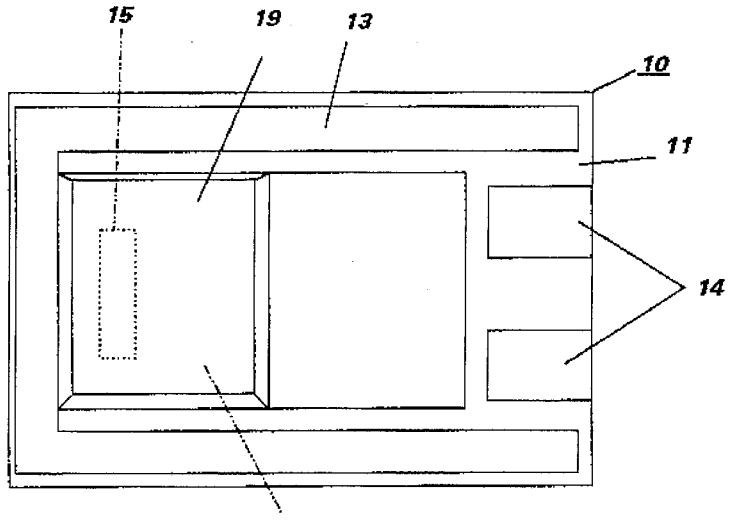
FIG. 3 is a bottom view of an upper fixed base constructing in the above relay.
Figure 5:
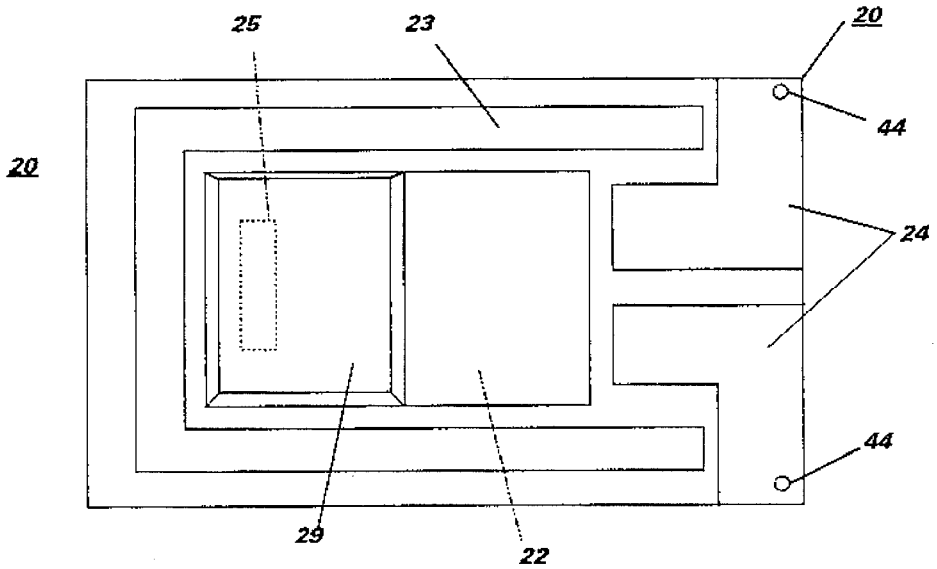
FIG. 5 is a top view of a lower fixed base constructing the above relay.

Referring now to FIGS. 1 and 2, there is shown an electrostatic relay in accordance with a first embodiment of the present invention. The relay comprises a pair of upper and lower fixed bases 10 and 20 each in the form of a rectangular plate made of a mono-crystalline silicon wafer. Lower fixed base 20 is considered the primary fixed base while upper fixed base 10 is considered the secondary fixed base. Disposed between the upper and lower fixed bases 10 and 20 is an actuator frame 30 shaped into a generally rectangular configuration also from a mono-crystalline silicon wafer. The upper and lower fixed bases 10 and 20 are each formed on its surface confronting the actuator frame 30 with an electrical insulation layer 11, 21 of SiO2 on which a fixed electrode 12, 22, a metal joint layer 13, 23, and a pair of fixed contacts 14, 24 are formed. The fixed contacts 14, 24 are formed on one longitudinal end of the base 10, 20 in a laterally spaced relation from each other, as shown in FIGS. 2, 3, and 5, while the joint metal layer 13, 23 extend around the border of the base 10, 20 except the longitudinal end where the fixed contacts are formed. The fixed electrode 12, 22 extends longitudinally between the longitudinal portion of the joint metal layer 13, 23 and the fixed contacts 14, 24 in a spaced relation therefrom. Disposed on the entire fixed electrodes 12 and 22 of the respective bases 10 and 20 are oppositely charged electret 19 and 29. Each of the fixed electrodes 12, 22 has a sink 15, 25 which penetrates through the insulation layer 11, 21 to be in direct electrical contact with the fixed base 10, 20 so that the fixed electrodes 12, 22 is charged through the base 10, 20 from a control voltage source V. The bases 10, 20 are each provided with a control terminal 16, 26 for wiring connection to the control voltage source. The joint metal layer 13, 23 are made of gold or gold-based alloy for welding with a corresponding metal layer on the actuator frame 30, as will be discussed later.

Figure 4:
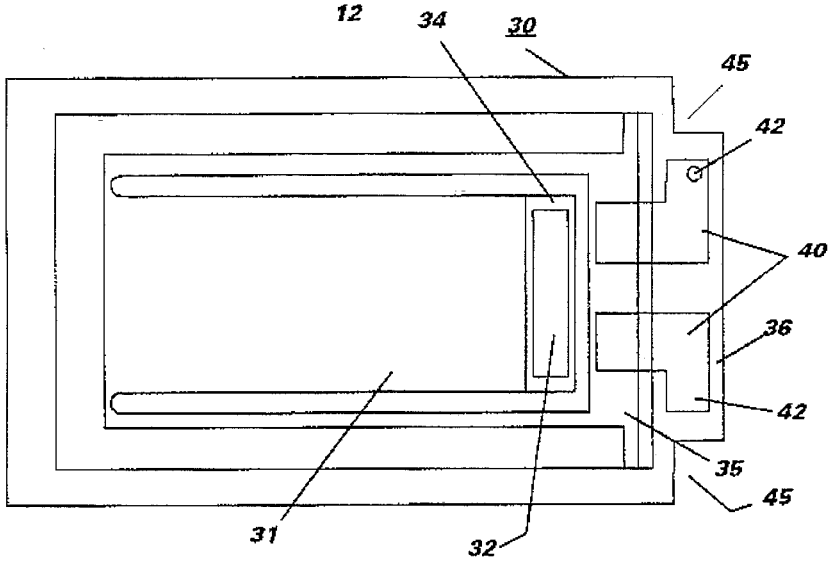
FIG. 4 is a top view of an actuator constructing the above relay.

The actuator frame 30 is formed integrally with an elongated movable electrode 31 extending in a lengthwise direction of the frame 30. The movable electrode 31 is shaped by anisotropic etching from the upper and lower surfaces of the frame 30 to have a reduced uniform thickness and to be separated from the three sides of the frame 30 such that it remains connected only at one longitudinal end thereof. Thus, the movable electrode 31 is integrally supported at its one longitudinal end to the frame 30 to be thereby allowed to pivot or swing about the supporting end. The movable electrode 31 is provided on its opposed surfaces at the free end thereof with movable contacts 32 and 33 each deposited on an electric insulation layer 34 to be electrically isolated from the movable electrode 31. As shown in FIGS. 2 and 4, the movable contact 32 and 33 each extends laterally in the form of a strip bridging the corresponding sets of fixed contacts 14 and 24, respectively when contacted therewith for conducting the set of the fixed contacts 14 and 24. The frame 30 is also formed in its upper surface by the above anisotropic etching with a recessed flange 35 which extends around the inner periphery of the frame 30 and defines an outer top flange 36 outwardly thereof. The lower surface of the frame 30 remains flush. The frame 30 is covered on its entire upper and lower surface with an electric insulation layer 37 of $SiO_2$. Joint metal layers 38 of the same kind as utilized for fixed bases 10 and 20 are disposed on the insulation layer 37 on the upper and lower surfaces of the frame 30 in such a manner as to extend along the periphery of the frame 30 except for one longitudinal end from which the movable electrode 31 extends. The metal layer 38 on the upper surface of the frame 30 is limited to the recessed flange 35, as shown in FIG. 1. Formed at the one longitudinal end and respectively on the upper and lower surfaces of the frame 30 are sets of terminal pads 40 and 41 which are electrically isolated from the frame 30 by means of the interposed insulation layer 38. Each set of the terminal pads 40 and 41 are composed of two separate members spaced laterally in correspondence to the fixed contacts 14 and 24 on the upper and lower bases 10 and 20. The joint metal layer 38 and the terminal pads 40 and 41 are placed against the corresponding metal layers 13 and 23 and against the fixed contacts 14 and 24 on the upper and lower fixed bases 10 and 20, respectively for metal bonding therebetween by eutectic reaction under pressure and heat. Thus, the upper base 10, the lower base 20, and the frame 30 are assembled into one unitary structure in which the movable electrode 31 is pivotally movable between positions of closing and opening the movable contacts 32 and 33 to and from the associated fixed contacts 14 and 24, respectively, while the fixed contacts 14 and 24 are electrically and mechanically connected to the terminal pads 40 and 41, respectively. The terminal pads 40 on the upper surface of the frame 30 extend from the recessed flange 35 on the top flange 36 and are connected to contact terminals 42 projecting on the top flange 36 for wiring connected to an external circuit (not shown). The lower fixed contacts 24 is provided respectively with contact terminals 44 which are exposed through notches 45 at the corners of the frame 30, as shown in FIGS. 2, 4, and 5, for wiring connection to another external circuit (not shown). The frame 30 is formed at one longitudinal end with a control terminal 46 for connection with the control voltage V.

In FIG. 1 the movable electrode 31 is shown in its neutral position between two operating positions of closing the upper movable contact 32 to the fixed contact 14 on the upper base 10 and of closing the lower movable contact 33 to the fixed contacts 24 on the lower base 20. As best shown in FIG. 1, the upper and lower bases 10 and 20 are each configured to have a step 17, 27 in the surface confronting the movable electrode 31. In conformity therewith, the fixed electrodes 12, 22 are formed respectively with step 18 and 28 such that the movable electrode 31 is spaced from each of the fixed electrode 12 and 22 by a gap which is narrower adjacent the supporting end of the movable electrode 31 than at the free end portion carrying the movable contacts 32 and 33 so that, when the electric potential is applied across the movable electrode 31 and the adjacent fixed electrodes 12 and 22, a greater electrostatic force is developed therebetween at the portion near the supporting end of the movable electrode 31 than the free end portion thereof for effectively attracting the movable electrode 31 towards either of the fixed electrodes 12 and 22. The electrets 19 and 29 are also formed respectively with corresponding steps by which the electrets are closer to the movable electrode 31 adjacent to the supporting end of the movable electrode 31 than the free end portion so as to exert additional electrostatic attractive force which is greater towards the supporting end of the movable electrode 31 than at the free end portion thereof.

Figure 6:
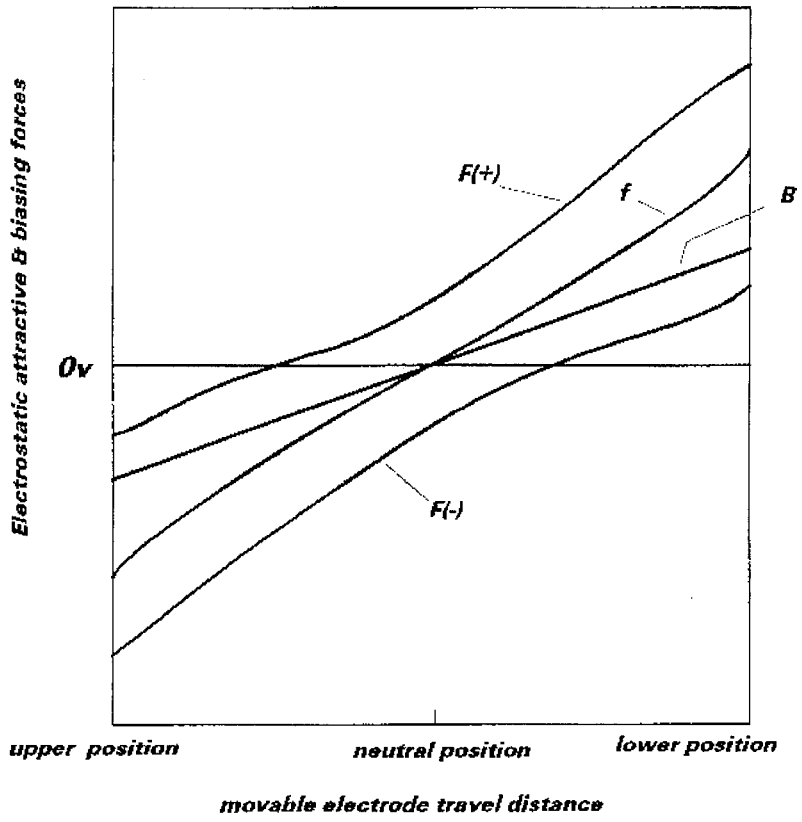
FIGS. 6 and 7 are graphs illustrating two different contacting operations of the above relay, respectively.

The upper electret 19 is positively charged, while the lower electret 29 is negatively charged to have same absolute charges as the upper electret 19 so that the electrets 19 and 29 exert the electrostatic attractive force of the same strength for attracting the movable electrode 31 when the movable electrode is in the neutral position of FIG 1. When moving between the two contact operating positions past the neutral position, the movable electrode 31 is given a mechanical force, i.e., biasing force of returning to the neutral position due to the mechanical deformation thereof. The strength of the electrostatic force by the electrets 19 and 29 are selected to be greater than the biasing force applied to the movable electrode 31 when the movable electrode 31 moves past the neutral position toward either of the two contact operating positions, thereby the movable electrode 31 is held stable both at the two operating positions of closing the movable contact 32 to the upper fixed contact 14 and of closing the movable contact 33 to the lower fixed contact 24. FIG. 6 shows the above relation of the electrostatic attractive force f by the electrets 19 and 29, the biasing force B, and also an electrostatic attractive force F(+) applied to the movable electrode 31 when the movable electrode 31 is charged to positive, and an electrostatic attractive force F(−) applied to the movable electrode 31 when it is charged negative. In FIG. 6, the electrostatic force f, F(+), F(−) are shown to act in the same direction as the biasing force B for easy comparison therebetween, although these forces actually act in the opposition direction.

Now, operation of the relay is discussed. When the control voltage source V is connected to apply the potential difference across the movable electrode 31 and the fixed electrodes 12 and 22 with the polarity shown in FIG. 1 to charge the movable electrode 31 positive (+), while charging the fixed electrodes 12 and 22 negative(−), the electrostatic attractive force developed between the movable electrode 31 and the upper fixed electrode 12 is opposed to the electrostatic force between the movable electrode 31 and the upper positive electret 19, while the electrostatic attractive force between the movable electrode 31 and the lower fixed electrode 22 is additive to the additional electrostatic force between the movable electrode 31 and the lower negative electret 29. In other words, there developed a less electrostatic attractive force between the upper positive electret 19 and the positively charged movable electrode 31 than in the absence of the applied potential, while a greater electrostatic attractive force is developed between the lower negative electret 29 and the positively charged movable electrode 31. Whereby, a torque is applied to pivot the movable electrode 31 downwards for contact with the lower fixed contacts 24, establishing the conduction therebetween. When, on the other hand, the reverse potential difference is applied across the movable electrode 31 and the fixed electrodes 12 and 22 to charge the movable electrode 31 negative, the electrostatic attractive force developed between the movable electrode 31 and the upper fixed electrode 12 is additive to the additional electrostatic force between the movable electrode 31 and the upper positive electret 19, while the electrostatic attractive force between the movable electrode 31 and the lower fixed electrode 22 is opposed to the additional electrostatic force between the movable electrode 31 and the lower negative electret 29. In other words, a greater electrostatic attractive force is developed between the upper positive electret 19 and the negatively charged movable electrode 31 than in the absence of the applied voltage, while a less electrostatic attractive force is developed between the lower negative electret 29 and the movable electrode 31 than in the absence of the applied voltages. Whereby, a reverse torque is produced to pivot the movable electrode 31 upward for contact of the upper movable contact 32 with the upper fixed contacts 14, establishing the conduction therebetween. It is noted here that, as shown in FIG. 6, the electrostatic attractive force f by the electrets 19 and 29 are selected to be greater than the biasing force B when the movable electrode 31 is in either of the two contact operating positions, the movable electrode 31 is kept latched to either of the two positions even after the applied voltage is removed and until the applied voltage is reversed. It should be noted here that the upper and lower electrets 19 and 20 are also formed with steps in conformity with those of the fixed electrodes 12 and 22 so that the additional electrostatic forces by the electrets 19 and 20 act effectively to the movable electrode 31.

Figure 7:
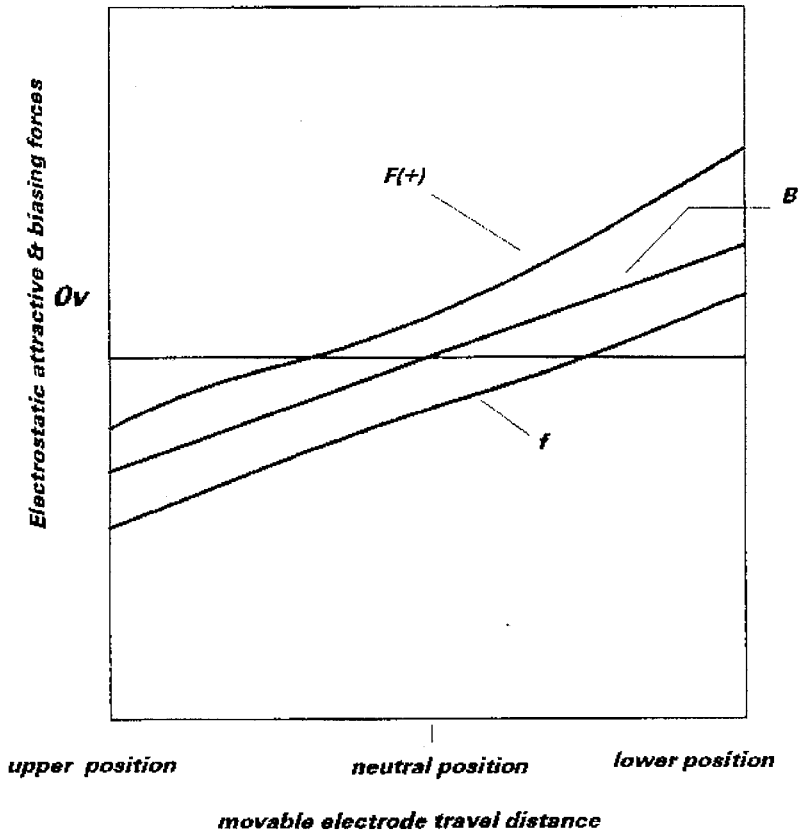

FIG. 7 illustrates a like relation between the electrostatic forces f, F(+), F(−), and the biasing force B applied to the movable electrode 31 when the upper positive electret 19 is modified to have a greater absolute charge than the lower negative electret 29. In this modification, the movable electrode 31 is attracted to the upper fixed electrode 132 by a greater electrostatic force exerted by the upper electret 19 than that by the lower electret 29, and held stable at the position of contacting the upper movable contact 32 with the upper fixed contacts 14. When the voltage is applied to charge the movable electrode positive and the fixed electrodes 12 and 22 negative, the movable electrode 31 is attracted to the lower electrode 22 for contact of the lower movable contact 33 with the lower fixed contacts 24. Due to the difference of the charges between the upper and lower electrets 19 and 29, the electrostatic attractive force by the lower electret 29 is made less than the biasing force B when the movable electrode 31 is in this position. Therefore, upon removal of the applied voltage, the movable electrode 31 is caused to return toward the neutral position by the biasing force and then attracted to the original position by the effect of the upper electret 19. Thus, the relay of this modification acts in a mono-stable operation mode.

In the meanwhile, since the upper and lower fixed bases 10 and 20 as well as the actuator frame 30 with the movable electrode 31 are made of silicone wafers, it is readily possible to provide a plurality of the individual members in a single sheet of the wafer and then assemble the members into the plurality of the relays at a time, after which each of the relays are separated from each other. Thus, the relays of this kind can be fabricated with enhanced productivity. As the fixed bases are made of silicone wafer, the fixed electrodes 12 and 22 can be formed by doping in the corresponding fixed bases. Further, it is readily possible to incorporate within the silicone base 10, 20 and/or frame 30 an driving IC for reversing the voltage applied across the movable electrode and the fixed electrodes as well as a step-up IC for generating the applied voltage from an external low voltage source.

Figure 8A:
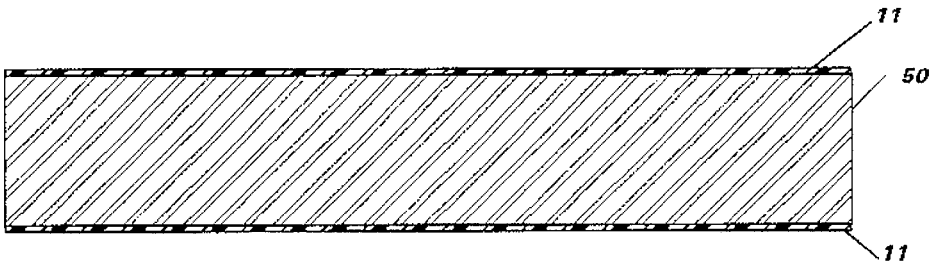
FIGS. 8A and 8F are sectional views illustrating the steps of forming the actuator frame.
Figure 8B:
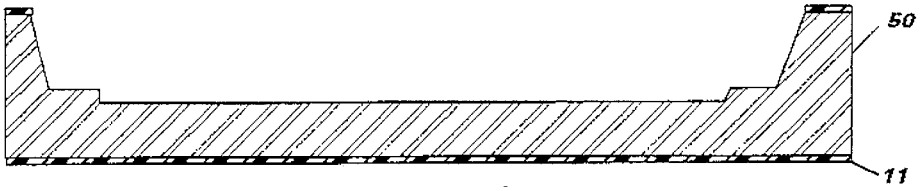
Figure 8C:
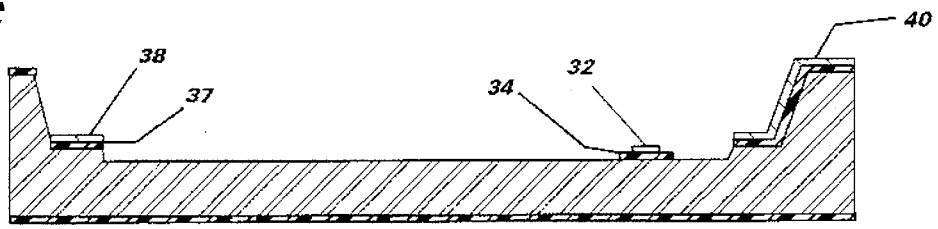
Figure 8D:
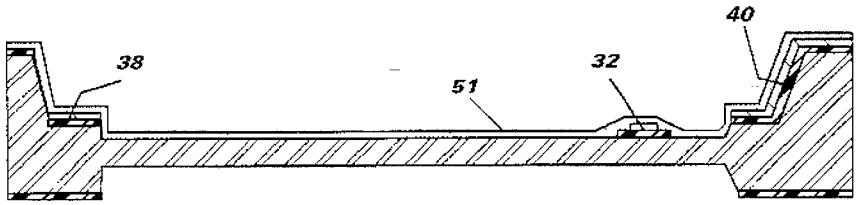
Figure 8E:
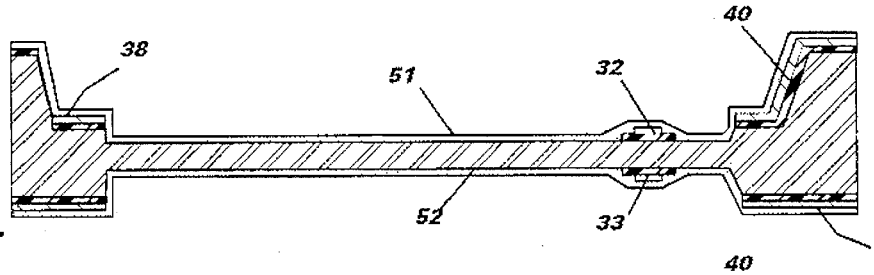
Figure 8F:
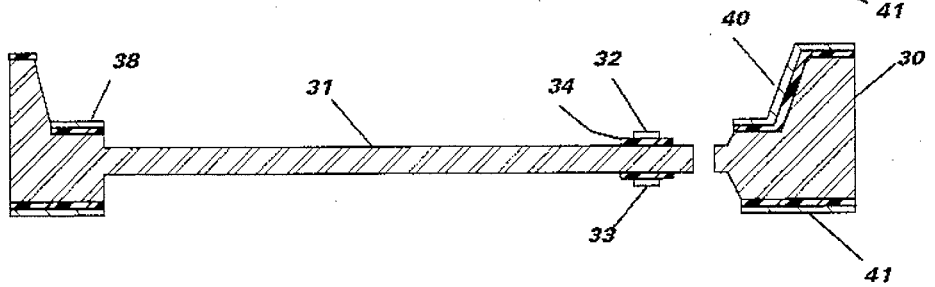

FIGS. 8A to 8F illustrate the steps of forming the actuator frame 30 integral with the movable electrode 31 from a blank 50 of silicon wafer by anisotropic etching. Firstly, the blank wafer 50 is coated on both sides with the insulation layers 11 (FIG. 8A), after which the upper surface thereof is concaved by the anisotropic etching (FIG. 8B). Then, the joint metal layer 38, upper movable contact 32, upper terminal pad 40 are formed along with the additional insulation layer 34 on the upper surface of the blank 50 (FIG. 8C). Nextly, the lower surface of the blank 50 is cut out by anisotropic etching with the entire upper surface covered with a protective film 51 (FIG. 8D) and is deposited with the lower movable contact 33 and the lower terminal pad 41 along with the additional insulation layer 34 inside of the contact 33. Subsequently, the entire lower surface of the blank 50 is covered with a like protective film 52 (FIG. 8E). Finally, the reduced thickness portion of the blank 50 is separated by the like etching from the surrounding portion with only one longitudinal end thereof kept continuous therewith, after which the protective films 51 and 52 are removed (FIG. 8F).

Figure 9A:
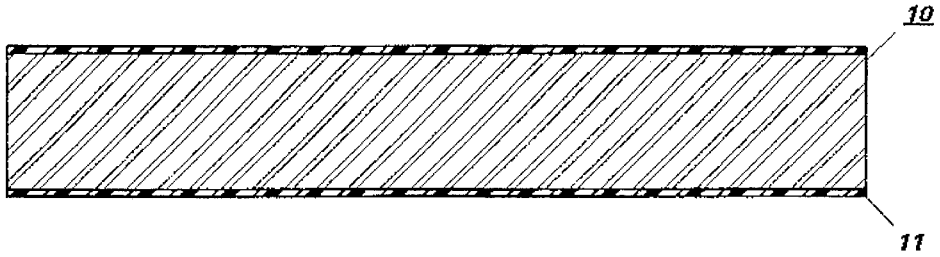
FIGS. 9A to 9E are sectional views illustrating the steps of forming the upper fixed base.
Figure 9B:
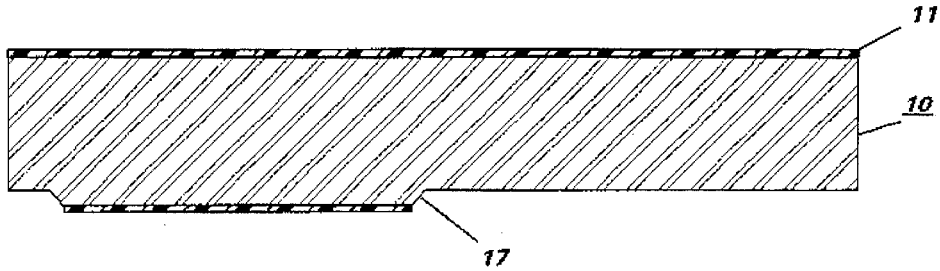
Figure 9C:
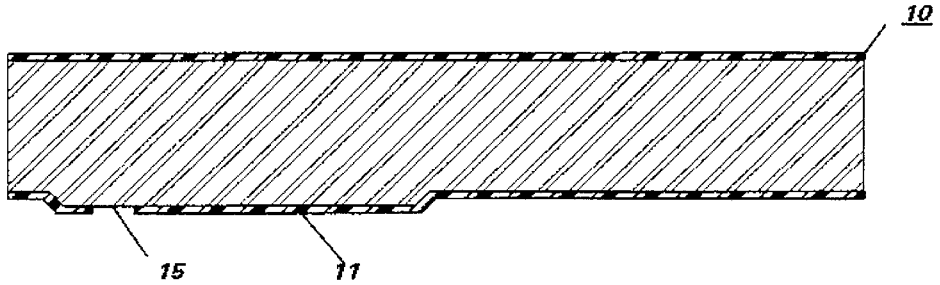
Figure 9D:
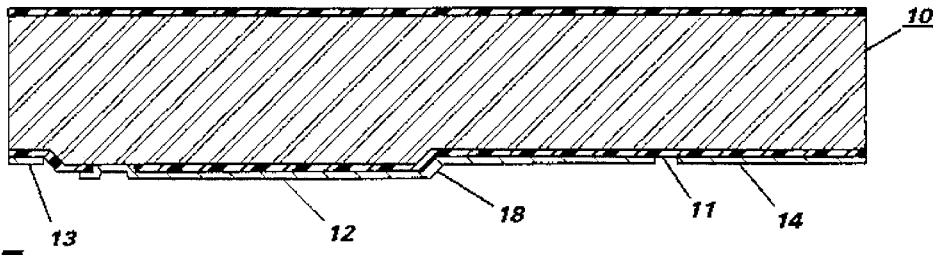
Figure 9E:
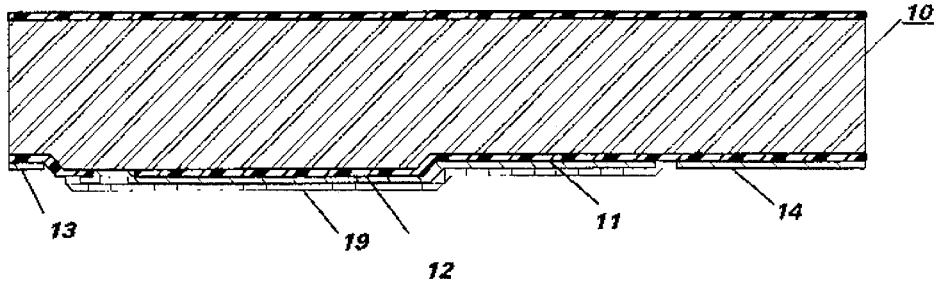

FIGS. 9A to 9E illustrate the steps of forming the necessary members on the upper fixed base 10. Firstly, the base 10 is coated on its surfaces respectively with the insulation layers 11 (FIG. 9A), after which the lower surface of the base 10 is cut out by the anisotropic etching to form thereon the step 17 intermediate the length thereof (FIG. 9B). Then, the insulation layer 11 is added to cover the entire lower surface of the base 10 except for the sink 15 at which the base 10 is exposed (FIG. 9C). Subsequently, the joint metal layer 13, upper fixed electrode 12, and fixed contacts 14 are deposited on the insulation layer 11 with the fixed electrode 12 engaged into the sink 15 for electrical connection (FIG. 9D) and with the step 18 formed correspondingly on the electrode 12. Finally, the electret 19 is disposed on the fixed electrode 12 with the corresponding step formed thereon (FIG. 9E). The lower fixed base 20 are formed with the necessary members in the same manner as in the above.

Figure 10:
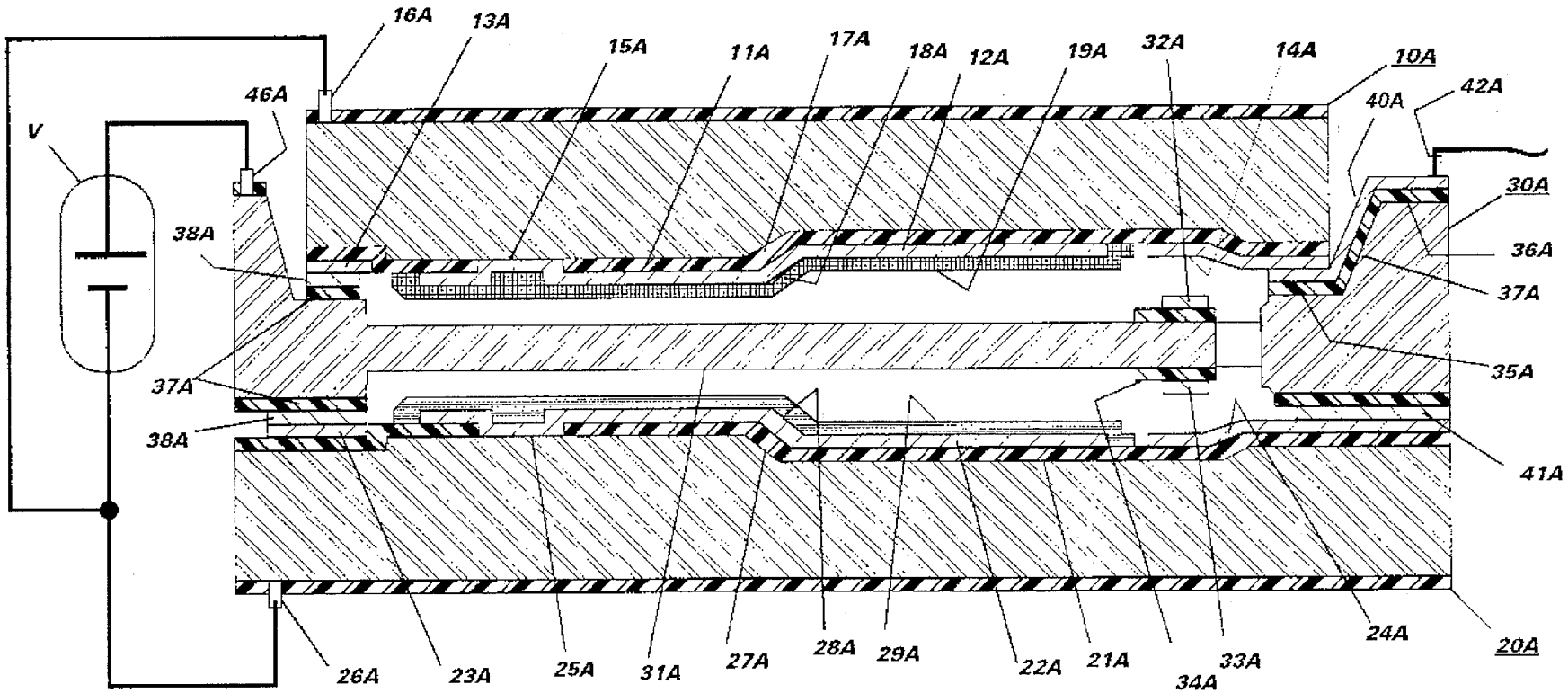
FIG. 10 is a front sectional view of an electrostatic relay in accordance with a second embodiment of the present invention.

FIG. 10 shows a like electrostatic relay in accordance with a second embodiment of the present invention which is identical in structure and operation to the first embodiment except that it is configured to have an increased travel distance of the movable contacts 32A and 33A for assuring sufficient electrically insulation distance between the movable contacts and the associated fixed contacts 14A and 24A. To this end, the fixed contacts 14A and 24A are recessed at the portions for contact with the movable contacts 32A and 33A than the remaining portions which are welded to the terminal pads 40A and 41A on the frame 30A, respectively. Correspondingly, the upper and lower fixed bases 10A and 20A and the associated insulation layers 11A and 21A are recessed in conformity with the configurations of the fixed contacts 14A and 24A, respectively. Like elements are designated by like numerals with a suffix letter of "A".

Figure 11:
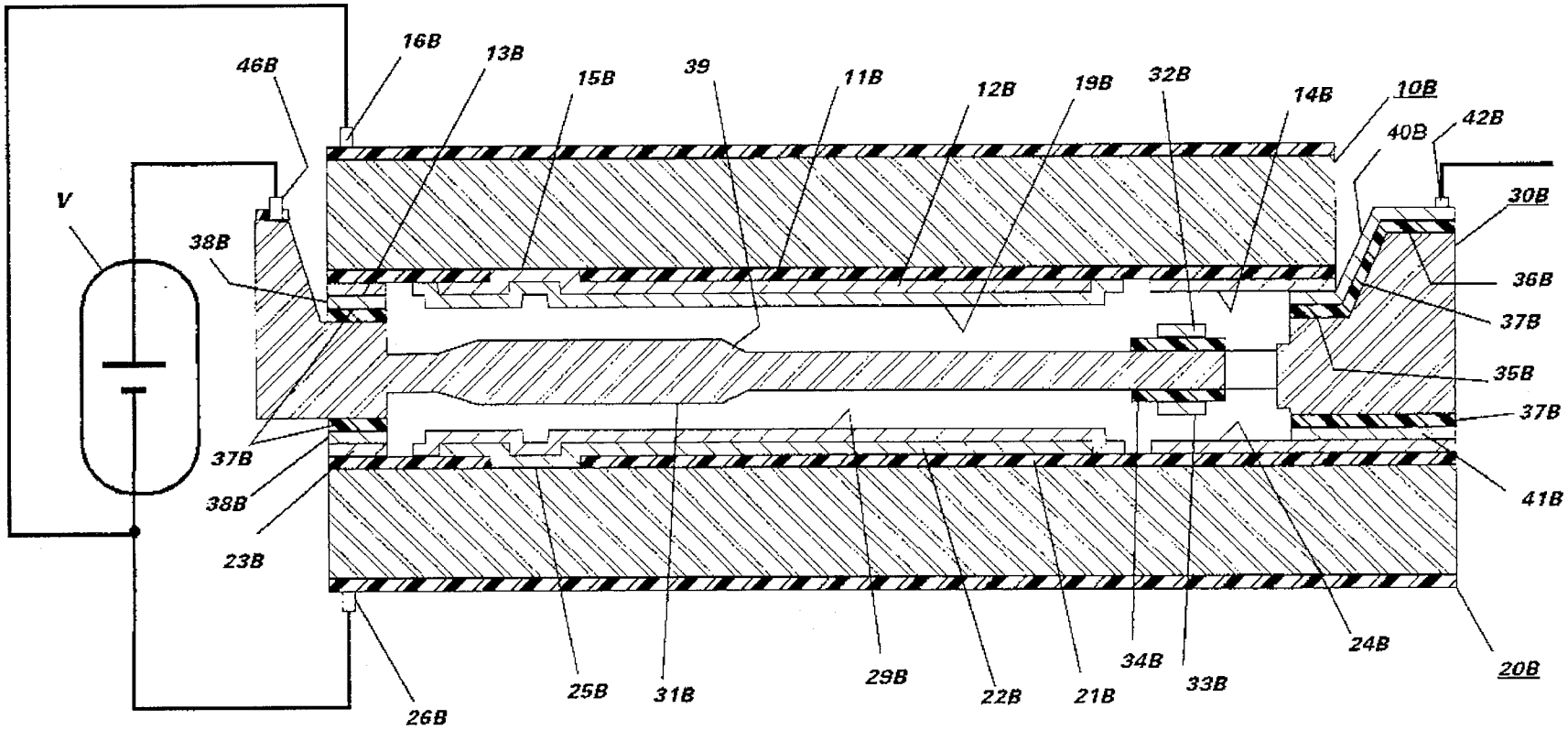
FIG. 11 is a front sectional view of an electrostatic relay in accordance with a third embodiment of the present invention.

FIG. 11 shows a like electrostatic relay in accordance with a third embodiment of the present invention which is identical in structure and operation to the first embodiment except that steps 39 is formed on the upper and lower surfaces of the movable electrode 31B instead of on the fixed electrodes 12B and 22B. The steps 39 are formed intermediate the length of the movable electrode 31B such that the gap between the between the movable electrode 31B and the adjacent fixed electrodes 12B and 22B and also between the movable electrode 31B and the adjacent electrets 19B and 29B is made narrower at portion adjacent to the pivotally supporting end of the movable electrode 31B than the other longitudinal or free end portion thereof. Thus, the relay of this embodiment operates in the same manner as in the first embodiment. Like parts are designated by like numerals with a suffix letter of "B".

Figure 12:
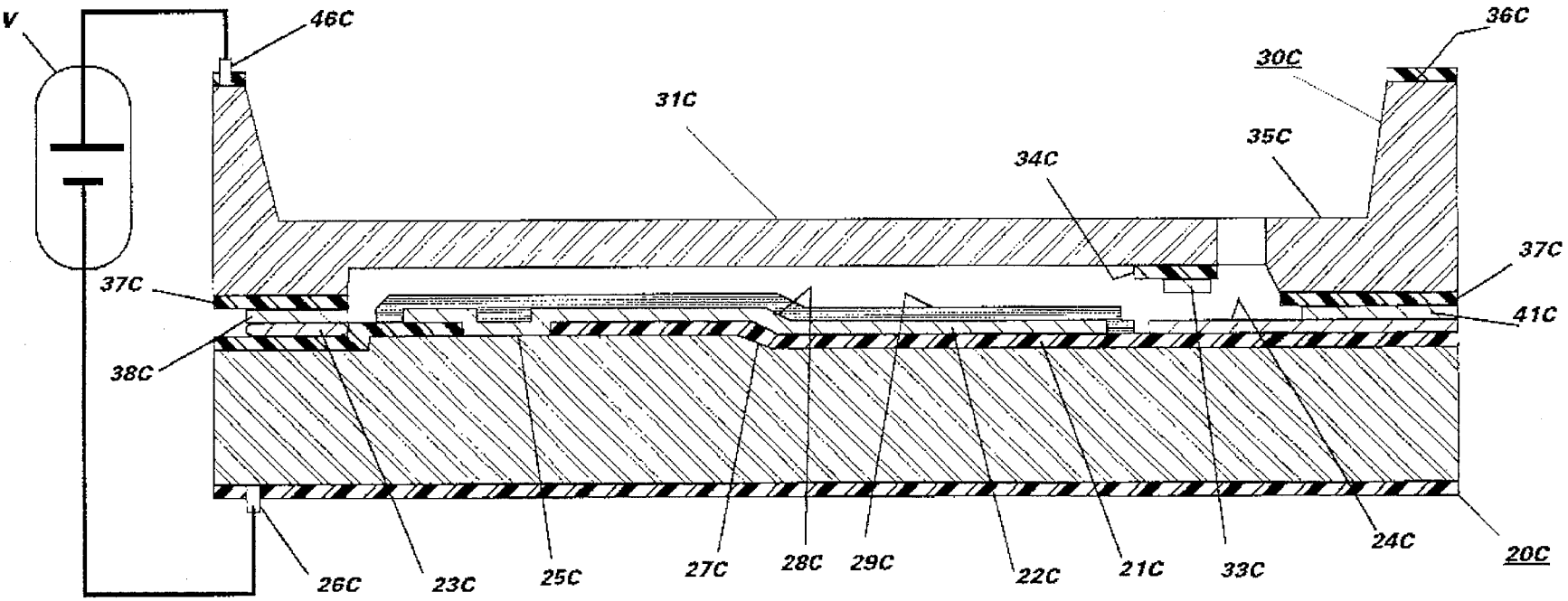
FIG. 12 is a front sectional view of an electrostatic relay in accordance with a fourth embodiment of the present invention.

FIG. 12 shows a like electrostatic relay in accordance with a fourth embodiment of the present invention which is similar to the first embodiment except that it utilizes only one fixed base 20C. That is, the relay of this embodiment corresponds to the structure of the first embodiment from which the upper fixed base 10 and the associated elements are removed. The control voltage is therefore applied across the movable electrode 31C and the fixed electrode 22C for moving the movable electrode 31C towards and away from the fixed electrode 22C for closing and opening the movable contact 33C to and from the fixed contacts 24C. Like parts are designated by like numerals with a suffix letter of "C".

Figure 13:
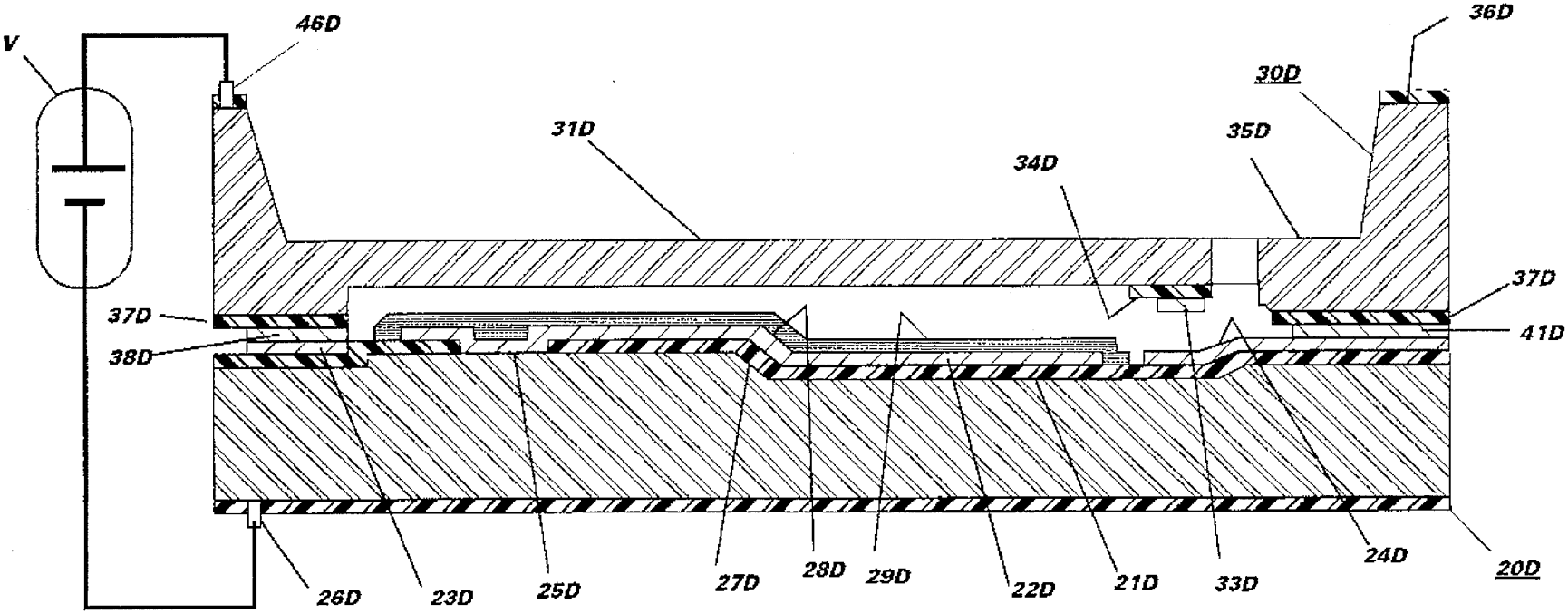
FIG. 13 is a front sectional view of an electrostatic relay in accordance with a fifth embodiment of the present invention.

FIG. 13 shows a like electrostatic relay in accordance with a fifth embodiment of the present invention which is similar to the second embodiment except that it utilizes only one fixed base 20D. That is, the relay of this embodiment corresponds to the structure of the second embodiment from which the upper fixed base 10A and the associated elements are removed. The control voltage is therefore applied across the movable electrode 31D and the fixed electrode 22D for moving the movable electrode 31D towards and away from the fixed electrode 22D for closing and opening the movable contact 33D to and from the fixed contacts 24D. Like parts are designated by like numerals with a suffix letter of "D".

Figure 14:
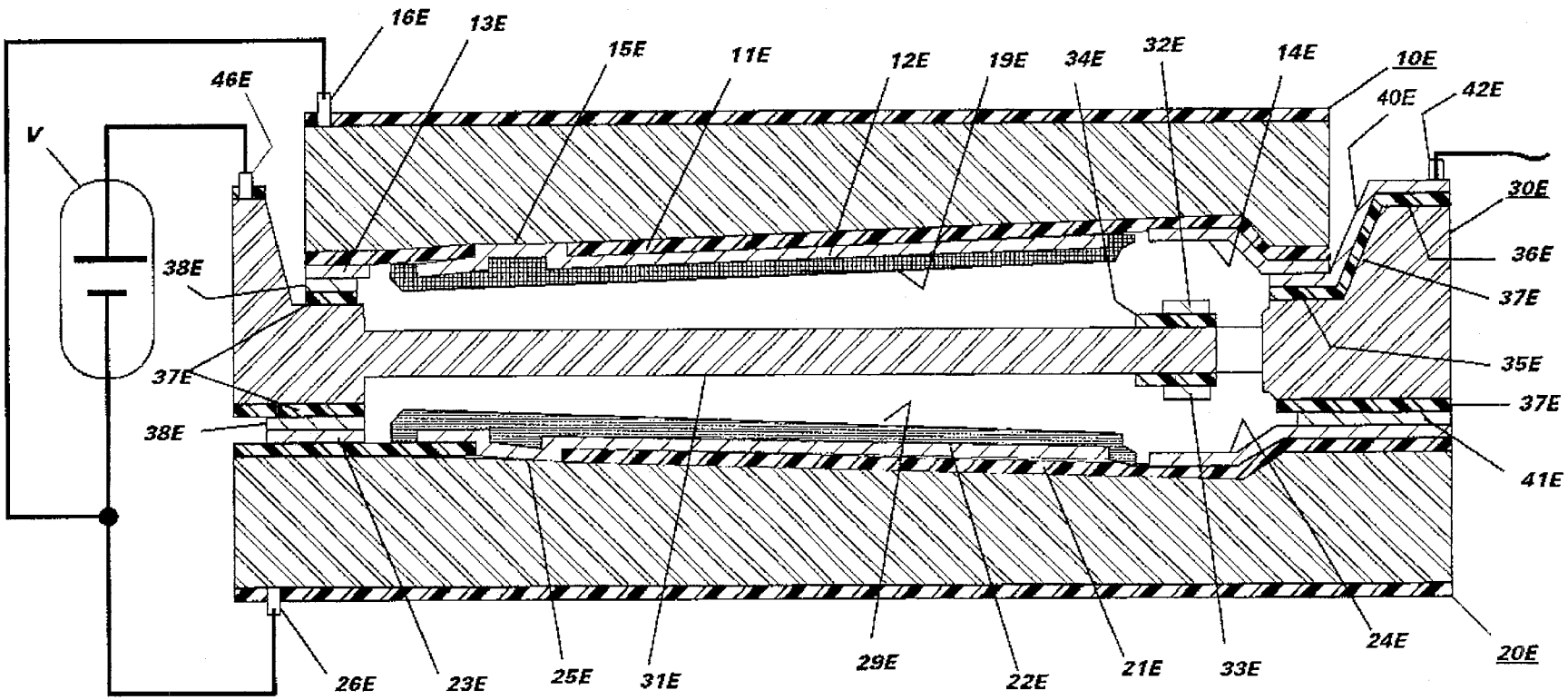
FIG. 14 is a front sectional view of an electrostatic relay in accordance with a sixth embodiment of the present invention.
Figure 15A:
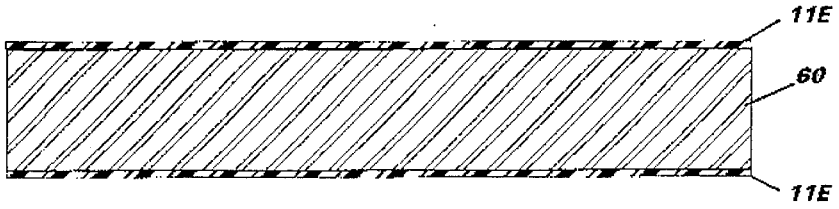
FIGS. 15A to 15E are sectional views illustrating the steps of forming an upper fixed base employed in the relay of FIG. 14.
Figure 15B:
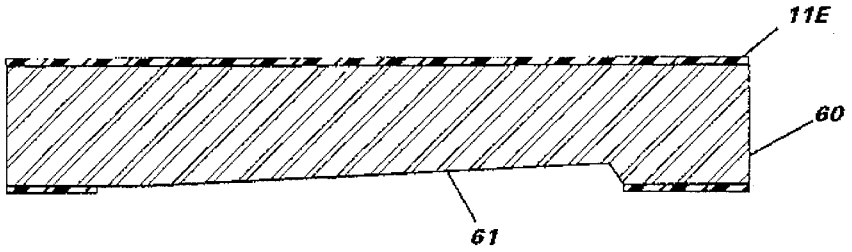
Figure 15C:
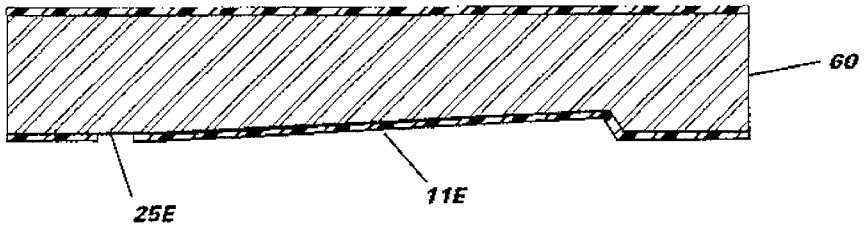
Figure 15D:
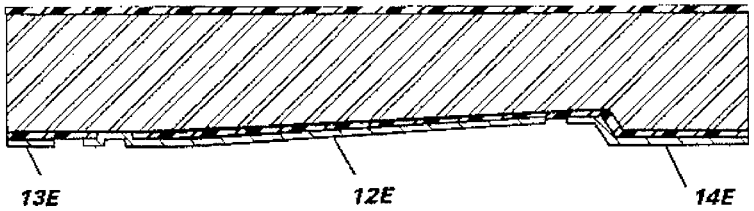
Figure 15E:
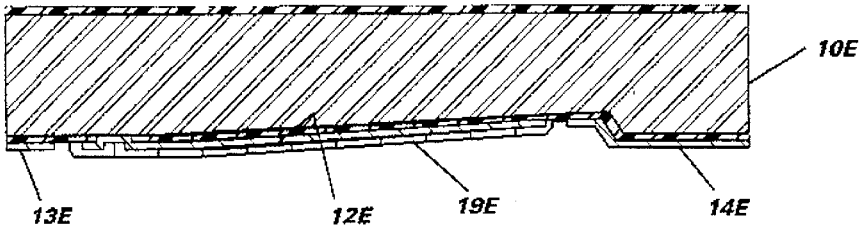
Figure 16:
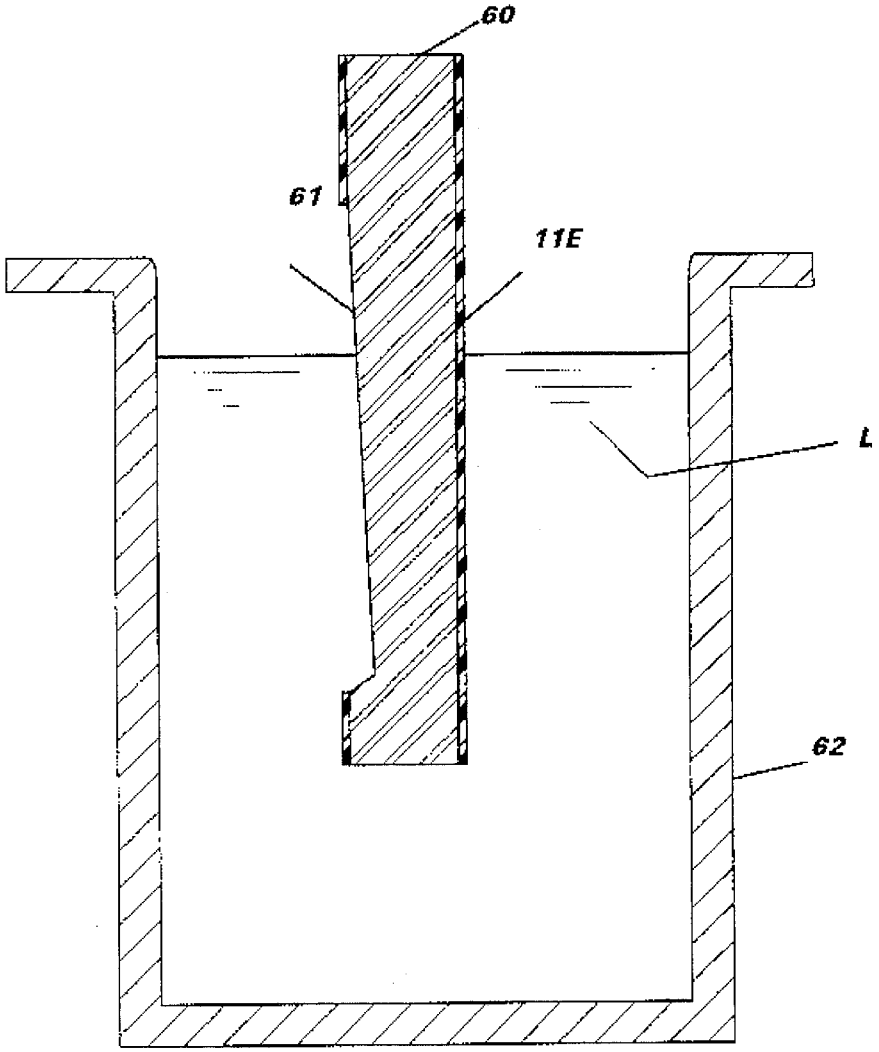
FIG. 16 is a sectional view illustrating the way of forming the fixed base of the relay of FIG. 14.

FIG. 14 shows a like electrostatic relay in accordance with a sixth embodiment of the present invention which is similar to the first embodiment except that the upper and lower fixed electrodes 12E and 22E as well as the electrets 19E and 29E are inclined relative to the movable electrode 31E so that the gap between the movable electrode 31E and the fixed electrodes 12E and 22E as well as between the movable electrode 31E and the electrets 19E and 29E is made continuously narrower towards the supporting end of the movable electrode 31E than the free end thereof. Thus, the electrostatic attracting forces developed between the movable electrode 31E and the fixed electrode 12E and 22E and between the movable electrode 31E and the electrets 19E and 29E acts intensively to the supporting end of the movable electrode 31E, thereby assuring to give a maximum contacting pressure with a minimum applied electrostatic force, yet assuring a sufficient insulation distance between the movable contact and the fixed contacts in an open contact condition, as is achieved in the previous embodiments. Like parts are designated by like numerals with a suffix letter of "E". FIGS. 15A to 15E illustrate the step of forming the upper fixed electrode 10E and the associated elements thereon. Firstly, a silicone made blank 60 is coated on both surfaces with $SiO_2$ insulation layers 11E (FIG. 15A), after which the lower surface thereof is concaved by the anisotropic etching to give an inclined surface 61 with corresponding portion of insulation layer 11E being removed of (FIG. 15B). As shown in FIG. 16, the etching step includes withdrawing the blank 60 from an etching liquid L in a container 62 at a constant rate for controlling the attaching depth, i.e., the inclination. Then, the insulation layer 11E is added on the inclined surface 61 while leaving a sink 25E for electrical contact with the fixed electrode 12E (FIG. 15C), followed by deposition of the joint metal layer 13E, the fixed electrode 12E, as well as the fixed contacts 24E on the lower insulation layer 11E in a spaced relation from each other (FIG. 15D) and with the fixed electrode 12E inclined correspondingly. Thereafter, the electret 19E is disposed on the fixed electrode 12E in an inclined fashion (FIG. 15E). The lower fixed base 20E and the associated elements are formed in the identical manner as in the above.

What is claimed is:

1. An electrostatic relay comprising:

a fixed base having a fixed electrode with a pair of fixed contacts which are insulated from said fixed electrode;

an actuator frame secured on said fixed base and having an elongate movable electrode with a movable contact insulated from said movable electrode, said movable electrode extending along said fixed electrode and being pivotally supported at one longitudinal end to said actuator frame so that said movable electrode is allowed to pivot between two contacting positions of closing and opening said contacts, said movable contact being formed at the other longitudinal end of said movable electrode; and a control voltage source connected across said fixed electrode and said movable electrode to generate a potential difference therebetween for developing an electrostatic force by which said movable electrode is attracted toward said fixed electrode to move into one of said two contacting positions, wherein said movable electrode is cooperative with said fixed electrode to define therebetween a first elongate gap along a first portion of a length of said movable electrode which is narrower toward said one longitudinal end about which said movable electrode is pivotable than a second elongate gap along a second portion of the length of said movable-electrode toward the other longitudinal end of said movable electrode at which said movable contact is carried.

2. An electrostatic relay as set forth in claim 1, wherein said movable electrode is formed on its surface confronting said fixed electrode with at least one step separating said first and second elongate gaps.

3. An electrostatic relay as set forth in claim 1, wherein said fixed electrode carries an electret which is disposed adjacent said movable electrode to give an additional electrostatic force of attracting said movable electrode towards said fixed electrode.

4. An electrostatic relay as set forth in claim 1, wherein said fixed base and said actuator frame are each formed of a silicon wafer and wherein said fixed electrode is disposed on said fixed base, while said movable electrode is cut out from said actuator frame to be integral therewith.

5. An electrostatic relay as set forth in claim 1, further including a secondary fixed base which is disposed opposite said fixed base from said actuator frame, said secondary fixed base having a secondary fixed electrode confronting said movable electrode for applying a potential difference therebetween, said secondary fixed base formed with a secondary pair of fixed contacts which come into contact with an additional contact formed on said movable electrode, said fixed base and said secondary fixed base are stacked on said actuator frame and integrally bonded thereto.

6. An electrostatic relay as set forth in claim 5, wherein said fixed electrode carries an electret which is disposed adjacent said movable electrode to produce an additional electrostatic force attracting said movable electrode toward said fixed electrode, and wherein said secondary fixed base carries a secondary electret which is disposed adjacent to said movable electrode and is charged opposite from said electret on the fixed electrode to produce an additional electrostatic force attracting said movable electrode to said secondary fixed electrode.

7. An electrostatic relay comprising:

a fixed base having a fixed electrode with a pair of fixed contacts which are insulated from said fixed electrode;

an actuator frame secured on said fixed base and having an elongate movable electrode with a movable contact insulated from said movable electrode, said movable electrode extending along said fixed electrode and being pivotally supported at one longitudinal end to said actuator frame so that said movable electrode is allowed to pivot between two contacting positions of closing and opening said contacts, said movable contact being formed at the other longitudinal end of said movable electrode; and a control voltage source connected across said fixed electrode and said movable electrode to generate a potential difference therebetween for developing an electrostatic force by which said movable electrode is attracted toward said fixed electrode to move into one of said two contacting positions, wherein said movable electrode is cooperative with said fixed electrode to define therebetween a first elongate gap along a first portion of a length of said movable electrode which is narrower toward said one longitudinal end about which said movable electrode is pivotable than a second elongate gap along a second portion of the length of said movable-electrode toward the other longitudinal end of said movable electrode at which said movable contact is carried, and wherein said fixed electrode is formed on its surface confronting said movable electrode with at least one step separating said first and second elongate gaps.

* * * * *